United States Patent [19]

Debo

[11] Patent Number: 4,616,873

[45] Date of Patent: Oct. 14, 1986

[54] ROCKER SAFETY BOOT

[76] Inventor: Joseph G. Debo, 70 Puritan Rd., Tonawanda, N.Y. 14150

[21] Appl. No.: 779,818

[22] Filed: Sep. 25, 1985

[51] Int. Cl.[4] ..... A47C 3/02

[52] U.S. Cl. ..... 297/272; 257/463

[58] Field of Search ..... 257/272, 270, 269, 463

[56] References Cited

U.S. PATENT DOCUMENTS

| | | | |
|---|---|---|---|
| 509,663 | 11/1893 | Holloway | 297/272 |
| 740,278 | 9/1903 | Howe | 297/272 |
| 1,317,580 | 9/1919 | Kanode | 297/272 |
| 1,435,432 | 11/1922 | Toth | 297/272 |
| 3,669,490 | 6/1972 | Bertolet | 297/272 |

*Primary Examiner*—Peter A. Aschenbrenner
*Attorney, Agent, or Firm*—Robert C. Weber

[57] ABSTRACT

A safety boot for freely enclosing each rocker of a rocking chair, the inventive rocker safety boot comprises an elongated bottom wall of greater width and length than each rocker and adapted to support each rocker; elongated front and rear walls extending upwardly from the front and rear ends respectively for the bottom wall, and adapted to extend sufficiently above the highest rise of the front and rear ends respectively of the bottom wall, and adapted to extend sufficiently above the highest rise of the front and rear ends respectively of each rocker, in order to enclose the same when so elevated; elongated outer and inner side walls of greater height and length than each rocker connecting the walls, extending upwardly from bottom wall, and adapted to enclose each rocker and its connecting legs during rocking; and an elongated flexible cover connecting the end walls and side walls and adapted to enclose each rocker and its connecting legs.

6 Claims, 6 Drawing Figures

Fig. 1.
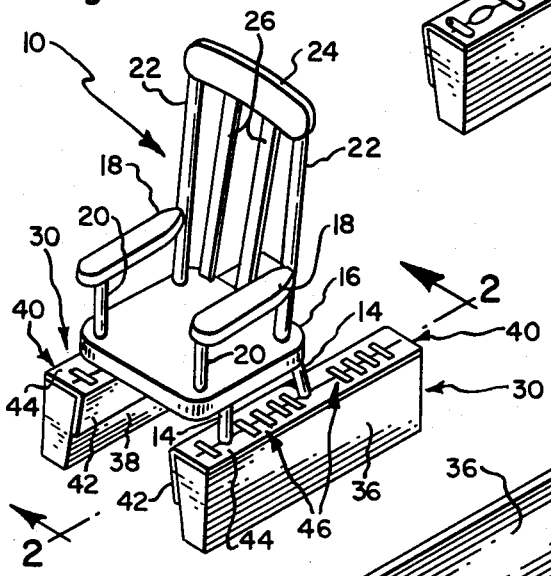
Fig. 5.
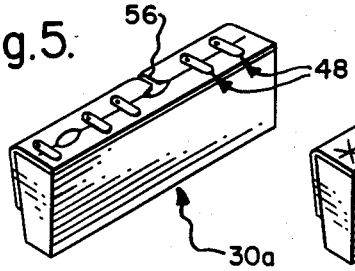
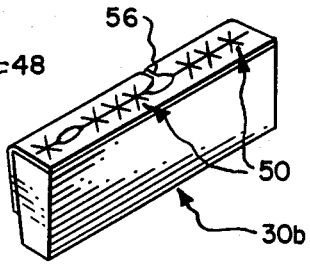
Fig. 6.
Fig. 3.
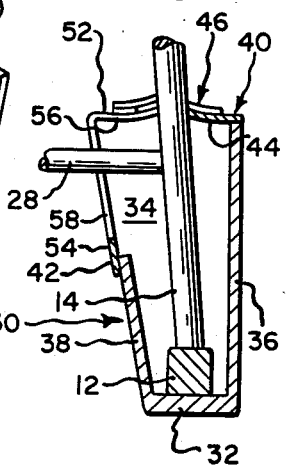
Fig. 4.
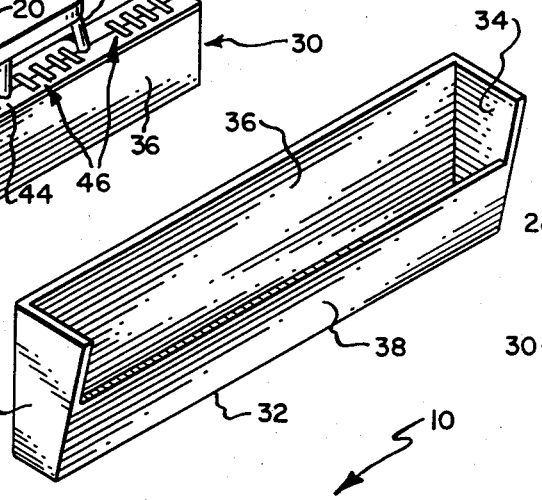
Fig. 2.
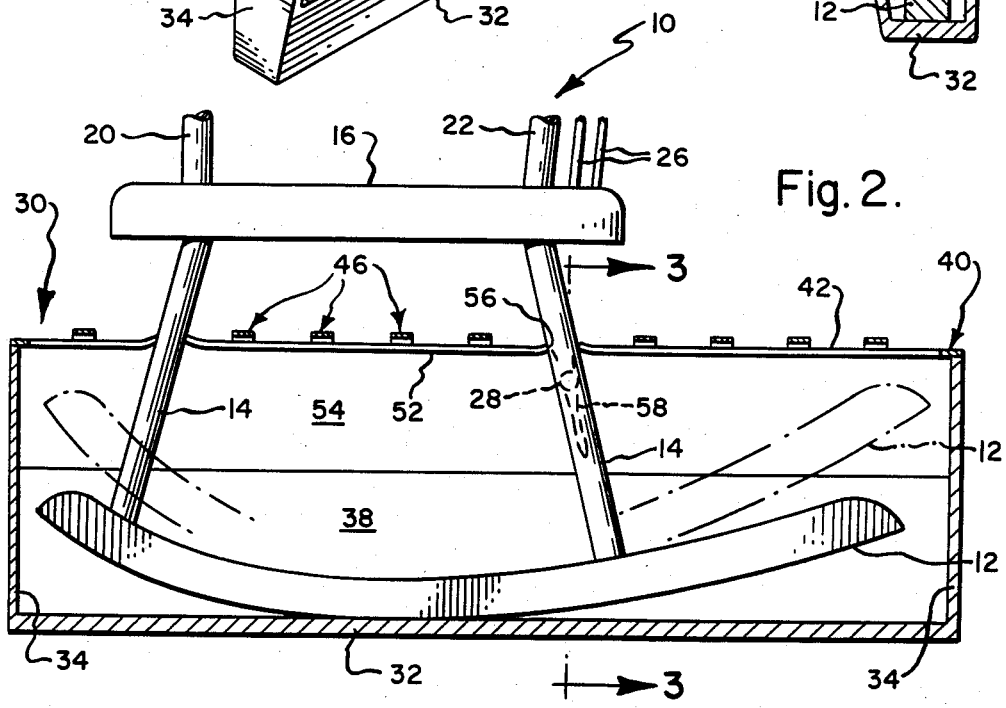
77981B

ROCKER SAFETY BOOT

BACKGROUND OF THE INVENTION

1. Field of the Invention

This invention relates to rocking chairs, and more particularly to a new and improved safety boot for freely enclosing each rocker of a rocking chair.

2. Prior Art

Rocking chairs have been popular articles of furniture for many years. Unfortunately, human extremities have a way of getting caught between the bottom of the rocker and the floor. This is particularly true of a child, who is playing in the area, while another child, is rocking, although older people also manage to have their fingers and/or toes so pinched.

However, the inventor is unaware of any successful attempts to alleviate this problem, with the possible exception of U.S. Pat. No. 3,669,490 to Bertolet, which discloses a rubber shoe fitted over the rockers, expressly for protecting the floor, according to the patentee. While the rubber shoe, which moves with the rocker, might cushion the force pinching the extremity beneath the rocker, it still does not prevent the extremity from being caught in the first place.

Other patents known to the inventor are even less relevant. U.S. Pat. No. 331,111 to Batton merely discloses a convertible chair which can be mechanically adjusted between stationary, rocking, rolling and inclined positions, and which can be used as a swing, especially for invalids, but offers no protection against pinching of human extremities beneath the rockers. U.S. Pat. No. 956,547 to Smith teaches a rocking chair which is mechanically adjustable to the size of the user, has downwardly curved depending pads at the rear of each rocker to prevent tipping over backward, and is designed to rock on rails on the floor. Once again, there is no protection against injury, especially to a person's fingers and toes being pinched between the rockers and the rails or floor.

SUMMARY OF THE INVENTION

Accordingly, a general primary objective of the present invention is to provide a new and improved safety boot for freely enclosing each rocker of a rocking chair, and which boot is so constructed and designed as to overcome the various deficiencies in the aforesaid prior art, by preventing injury to human extremities caused by pinching between each rocker and the floor, while at the same time permitting the desired rocking motion. To this end, the inventive rocker safety boot comprises an elongated bottom wall of greater width and length than each rocker and adapted to support each rocker; elongated front and rear walls extending upwardly from the front and rear ends respectively of the bottom wall, and adapted to extend sufficiently above the highest rise of the front and rear ends respectively of each rocker, in order to enclose the same when so elevated; enlongated outer and inner side walls of greater height and length than each rocker connecting the end walls, extending upwardly from bottom wall, and adapted to enclose each rocker and its connecting legs during rocking; and an elongated flexible cover connecting the end walls and side walls and adapted to enclose each rocker and its connecting legs; said cover being split longitudinally into inner and outer sections to permit installation and removal of the boot, as well as to provide spacing for movement of the legs during rocking; and means for removably fastening the split cover sections together lengthwise above each rocker.

A specific primary objective of the present invention is to provide such new and improved rocker safety boot, wherein the rocking chair includes a rung connecting one of the front and rear legs on one rocker with the corresponding one of the front and rear legs on the other rocker, the inner side wall is of shorter height than the outer side wall to eliminate the generation of a pinch point with the rung; the inner cover section extends downwardly from the end walls and over the upper end of the inner side wall to complete the enclosure, and is slit laterally to permit movement of the rung during rocking.

A more specific primary objective of the present invention is to provide such new and improved rocker safety boot, wherein the legs connecting each rocker to the chair seat incline upwardly and inwardly, the inner edges of the end walls and the inner side wall likewise are so inclined, to provide adequate clearance for the legs, and the inner cover section includes an upper portion extending laterally inwardly over the end walls and a lower portion extending downwardly from the upper portion and over the upper end of the inner side wall to complete the enclosure; with both of the upper and lower portions of the inner cover section being slit laterally to permit movement of the rung during rocking.

A still more specific primary objective of the present invention is to provide such new and improved rocker safety boot, wherein the fastening means are in the form of readily engagable and disengagable fibrous hook and loop carrying strips, or snaps, or laces.

Additional objectives and advantages of the invention will become evident upon consideration of the following detailed description and the accompanying drawing wherein:

BRIEF DESCRIPTION OF THE DRAWING

FIG. 1 is a perspective view of a rocking chair having each of its two rockers equipped with a rocker safety boot constituting a preferred embodiment of the invention;

FIG. 2 is an enlarged section taken generally along line 2—2 of FIG. 1, and illustrating structural details of both the rocking chair and the inventive boot embodiment of FIG. 1;

FIG. 3 is a section taken generally along line 3—3 of FIG. 2 and illustrating further detailed structure;

FIG. 4 is an enlarged perspective view of a preferred inventive boot embodiment, but with the cover removed;

FIG. 5 is a perspective view of another preferred embodiment of the inventive boot, wherein snaps are employed to fasten the split cover sections together, instead of the fibrous hook and loop engaging strips of FIG. 1, and FIG. 6 is a view similar to FIG. 5, but illustrating lace fasteners.

DESCRIPTION OF THE PREFERRED EMBODIMENTS

Referring to the drawing, and particularly FIGS. 1 and 2, a typical rocking chair is generally indicated at 10, and includes a pair of rockers 12, front and rear legs 14 connecting each rocker 12 with a seat 16, upon which are mounted arms 18 by front supports 20 and upright rear supports 22 connected by headrest 24 to form a chair back, which is completed by intermediate supports 26. Legs 14 on each rocker, as shown in FIG. 2, incline upwardly and inwardly toward each other, as well as upwardly and inwardly, as shown in FIG. 3. In the particular chair illustrated, rear legs 14 on each rocker 12 are connected by a transverse or cross rung 28. Although not shown, front legs 14 also could be so connected, and legs 14 on each rocker 12 also could be connected by fore and aft rungs, as well.

A preferred embodiment of the inventive boot for each rocker is generally indicated at 30 in FIGS. 1–3. As such, it includes an elongated and generally rectangular bottom wall 32 which is of greater length and width than each rocker 12; upright front and rear end walls 34 extending upwardly from the front and rear ends respectively of bottom wall 32 and adapted to extend sufficiently above the highest rise of the front and rear ends respectively of rocker 12, in order to enclose the same when so elevated, as shown in dotted lines in FIG. 2, and upstanding and generally rectangular outer and inner side walls 36, 38 of greater height and length than rocker 12, connecting end walls 34, extending upwardly from bottom wall 32, and adapted to enclose rocker 12 during rocking.

Boot 30 is provided with a flexible cover generally indicated at 40 as connecting end walls 34 and side walls 36, 38 and adapted to enclose each rocker 12 and its connecting front and rear legs 14. As shown in FIGS. 1–3, cover 40 is split longitudinally into inner and outer sections 42, 44 to permit installation and removal of boot 30, as well as to provide spacing for movement of front and rear legs 14 during rocking. Completion of the boot enclosure is accomplished by suitable means for removably fastening split cover sections 42, 44 together lengthwise above each rocker. In the preferred boot embodiment 30 of FIGS. 1–3, such fastening means is in the form of longitudinally spaced and transversely extending, readily engagable and disengagable overlapping fibrous hook and loop carrying strips generally indicated at 46, and sold under the trademark "Velcro". In the preferred embodiment 30*a* of FIG. 5, such fastening means is in the form of similarly positioned snaps generally indicated at 48; while in the preferred embodiment 30*b* of FIG. 6, such fastening means is in the form of similarly located laces generally indicated at 50. Otherwise, the several embodiments are the same.

Continuing with FIGS. 1–4, and particularly FIG. 4, it will be noted that the box portion or part of boot, 30 and composed of walls 32, 34, 36, 38 is rigid and self supporting, and could be made from any suitable material such as wood, composition board, plastic or the like, and could be assembled or molded in one piece as desired. As for cover 40, it likewise may be made of any suitable flexible material, such as woven or non-woven cloth, rubber, plastic or the like, and may be secured to the top edges of walls 34 and 36 and over wall 38 by any suitable means, such as an adhesive, not shown.

As seen in FIGS. 3 and 4, the cross-sectional configuration of boot 30 accommodates not only the desired rocking movement, but also the inclination and movement of legs 14 on each rocker 12, as well as the movement of rung 28 during such rocking. As best shown in FIG. 3, inner side wall 38 not only is of shorter height than vertical outer side wall 36, in order to eliminate generation of a pinch point with rung 28, but also is inclined upwardly and inwardly, as are legs 14 on each rocker 12, in order to provide adequate clearance for such legs. An included angle of 100 degrees with horizontal wall 32 has been found to be useful for this purpose.

In addition, inner cover section 42 includes upper portion 52 extending laterally inwardly over end walls 34 and lower portion 54 extending downwardly from upper portion 52 and over the upper end of inner side wall 38, to complete the enclosure. In order to accomodate the movement of rear leg 14 during rocking motion of the rocking chair embodiment 10 illustrated, both upper and lower portions are slit laterally at 56 and 58 respectively and if necessary to maintain shape, a removable fastener such as a snap or the like (not shown) could be added across slit 56.

As noted above the construction of a rocking chair can vary considerably from that illustrated, e.g. the provision of a cross-rung (not shown) connecting front legs 14 of each rocker pair, whereupon inner cover section would be slit laterally to accomodate such front cross rung, as well. Alternatively, the rocking chair could have fore and aft rungs (not shown) connecting legs 14 on each rocker. If fasteners such as 46,48 or 50 might impede rocking movement because of interference with such fore and aft rungs, the former could be loosened or removed in such areas. Still further, the rocking chair may be devoid of both cross and fore and aft rungs. Whereupon, the need for slitting and fastener adjustment would be obviated.

It now is seen how the invention accomplishes it various objectives, and numerous advantages of the invention also are apparent. While the invention has been described and shown herein by reference to certain preferred embodiments, it is to be understood that various changes and modifications may be made in the invention by one skilled in the art, without departing from the invention, the scope of which is to be determined by the appended claims.

What is claimed is:

1. A safety boot for freely enclosing each rocker of a rocking chair having front and rear legs respectively connecting the front and rear ends of each rocker to a seat, in order to prevent injury to human extremities caused by pinching beneath each rocker and the floor, while at the same time permitting the desired rocking motion, said boot comprising: an elongated bottom wall of greater width and length than each rocker and adapted to support each rocker; elongated front and rear end walls extending upwardly from the front and rear ends respectively of said bottom wall, and adapted to extend sufficiently above the highest rise of the front and rear ends respectively of each rocker, in order to enclose the same when so elevated; elongated outer and inner side walls of greater height and length than each rocker, connecting said end walls, extending upwardly from said bottom wall, and adapted to enclose each rocker and its connecting legs during rocking; and an elongated flexible cover connecting said end walls and said side walls and adapted to enclose each rocker and its connecting legs; said cover being split longitudinally into inner and outer sections to permit installation and removal of said boot, as well as to provide spacing for movement of the legs during rocking; and means for removably fastening the split cover sections together lengthwise above each rocker.

2. A safety rocker boot according to claim 1, wherein the rocking chair includes a rung connecting one of the front and rear legs on one of the rockers with the corresponding one of the front and rear legs on the other rocker, said inner side wall is of shorter height than said outer side wall to eliminate the generation of a pinch point with the rung; said inner cover section extends downwardly from said end walls and over the upper end of said inner side wall to complete the enclosure and is slit laterally to permit movement of the rung during rocking.

3. A safety rocker boot according to claim 2, wherein the legs connecting each rocker to the chair seat incline upwardly and inwardly, the inner edges of said end walls and said inner side wall likewise are so inclined to provide adequate clearance for the legs, and said inner cover section includes an upper portion extending laterally inwardly over said end walls and a lower portion extending downwardly from said upper portion and over the upper end of said inner side wall to complete the enclosure; with both of said upper and lower portions of said inner cover section being slit laterally to permit movement of the rung during rocking.

4. A safety rocker boot according to anyone of claims 1, 2 and 3, wherein said fastening means are in the form of readily engagable and disengagable fibrous hook and loop carrying strips.

5. A safety rocker boot according to anyone of claims 1, 2 and 3, wherein said fastening means are in the form of snaps.

6. A safety rocker boot according to anyone of claims 1, 2 and 3, wherein said fastening means are in the form of laces.

* * * * *